US006135141A

United States Patent [19]

Bombach

[11] Patent Number: 6,135,141

[45] Date of Patent: Oct. 24, 2000

[54] LOW PROFILE HIGH CAPACITY INSIDE DROP FOR A MANHOLE

[76] Inventor: Ken Bombach, 2460 Crestwood Dr., N. St. Paul, Minn. 55109

[21] Appl. No.: 09/461,472

[22] Filed: Dec. 14, 1999

[51] Int. Cl.[7] ..... B02D 29/12

[52] U.S. Cl. ..... 137/363; 137/372; 137/561 A; 52/20; 52/21

[58] Field of Search ..... 52/21, 20; 137/363, 137/372, 561 A

[56] References Cited

U.S. PATENT DOCUMENTS

| | | | |
|---|---|---|---|
| 3,212,519 | 10/1965 | Paschen | 137/363 |
| 3,662,918 | 5/1972 | Crawford et al. | 210/532.2 |
| 3,714,961 | 2/1973 | Davidson et al. | 137/363 |
| 4,023,590 | 5/1977 | Harris et al. | 137/363 |
| 4,566,483 | 1/1986 | Ditcher | 137/372 |
| 4,805,920 | 2/1989 | Gavin | 277/207 A |
| 4,887,933 | 12/1989 | Schaier | 405/36 |
| 5,553,973 | 9/1996 | Duran | 405/120 |

*Primary Examiner*—A. Michael Chambers
*Attorney, Agent, or Firm*—Nikolai, Mersereau & Dietz, P.A.

[57] ABSTRACT

A system for joining an expansion line to a main line of a sanitary sewage or storm sewage system. The system of the present invention joins an expansion line to a main line while reducing the amount of required excavation and minimizing the obstruction of a high capacity drainage line extending vertically within a manhole system.

20 Claims, 11 Drawing Sheets

LOW PROFILE HIGH CAPACITY INSIDE DROP FOR A MANHOLE

FIELD OF THE INVENTION

This invention relates generally to a system that may be used during the expansion of an existing drainage system and more particularly relates to a system for joining an expansion line to a main line of a sanitary sewage or storm sewage system. The system of the present invention joins an expansion line to a main line while reducing the amount of required excavation and minimizing the obstruction of a high capacity drainage line extending vertically within a manhole system.

BACKGROUND OF THE INVENTION

During the initial development of a community, a series of networked conduits are required to pipe sanitary sewage and storm sewage away from the community to, for example, a processing, treatment, or drainage site. Sanitary sewage and storm sewage systems are typically comprised of a plurality of networked pipelines that are buried in roadways deep enough to minimize the effects of heavy vehicles passing over the roadways and also deep enough (for example, below the frost line) to avoid the negative effects of freezing temperatures. In order to provide access to the pipeline for inspection and maintenance, manholes or catch basins are periodically interconnected within the networked pipelines. The manholes and/or catch basins are buried beneath the earth's surface, and typically below roadways, at depths of 10 feet or more.

When a manhole or catch basin is first constructed, it typically comprises a base, risers, cone, support frame and manhole cover or grate. The base includes a bottom with concentric sidewalls extending upward from the bottom. The lower portion of the base of the manhole is referred to as a canal-bed. The base of the manhole or catch basin structure may include one or more openings adapted to receive the pipeline, wherein the canal-bed includes a channel that directs fluid passing between the interconnected pipelines. One or more hollow cylindrical risers rest atop the base sidewalls, thereby increasing the sidewall of the manhole to a desired height. The cone is hollow and is stacked atop the uppermost riser, wherein one end of the cone is sized to fit on top of the riser and the other end of the cone has a reduced diameter suitable for receiving and supporting the support frame on top of the cone.

The base, risers and cone of the manhole structures are typically comprised of mortared blocks or pre-cast with concrete and may weigh several tons. Of course, the overall size of the base, including the internal and external diameters of the base sidewalls affects both the cost to manufacture the base and the cost to construct the manhole. Thus, it is desirable to decrease the diameter of the base as much as practical. However, oftentimes communities will require that an unobstructed inner diameter of the base, risers, and access opening must be equal or exceed predefined minimums for rigidity, stability and access. Hence, the desire to reduce costs associated with the manhole may be limited by minimum size requirements.

Over time it may be desirable to add or interconnect an additional drainage or sewage line to the main system. In the past, it has been customary to excavate the area around the manhole the entire depth of the manhole and interconnect the expansion pipeline to the main pipeline on the outside of the manhole. This connection of the expansion line to the main line is commonly referred to as an outside drop.

Although it would be preferable to pass the expansion line through a portion of the vertical cross section of the manhole (commonly referred to as an inside drop), thereby reducing the added expense associated with a complete excavation, the internal size requirements of the manhole does not typically allow for the added size of the convention pipeline. Hence, there is a need for an inside drop that, when positioned within the manhole, does not to exceed the internal size requirements.

Once the manhole or catch basin is constructed, fluids passing therethrough tend to deteriorate the structure. For example, sewage and putrid water are very acidic, and may comprise hydrogen sulfide and sulfuric acid. Over time, exposure to sewage or putrid water can damage the concrete of the canal-bed, base, and cone. In catch basins, road salt also has the same affect on the canal-bed. This is due to the eventual breakdown of the concrete by the road salt, especially if the concrete is of poor quality. When repair or replacement of these manhole/catch basin structures is required, due to a deteriorated canal-bed, base or cone, the procedure is extremely expensive, time consuming, and difficult. Hence, there is a further need for an inside drop capable of directing the fluid flowing from the expansion line into a particular desired portion of the canal bed and in a desired direction. The present invention meets these and other needs that will become apparent from a review of the description of the present invention.

SUMMARY OF THE INVENTION

The present invention provides for a low profile inside drop for linking a main sewage line to an expansion sewage line. The inside drop includes a drop line forming a fluid conduit between an expansion line and a main line. The drop line has an upper section adaptable for interconnection with the expansion line, a low profile middle section extending from a lower portion of the upper section and a lower section extending from a lower portion of the low profile middle section, wherein the lower section directs fluid into the main line. The drop line is attached to an internal sidewall of the manhole or catch basin structure with straps, bolts, or other fasteners of known suitable construction.

Without any limitation intended, the low profile middle section of the drop line has at least a partially oblong cross-section that conforms to the shape of the interior sidewall of the manhole or catch basin. An upper section of the drop line includes an access opening that provides access to the interconnection between the extension line and the drop line. A cover is provided to sealably engage the access opening formed in the drop line. The lower section of the drop line includes a directional member that may be positioned in any of a number of directions to thereby direct a flow of fluid in a desired direction and towards a desired portion of the canal bed.

The inside drop is suitable for use in conjunction with a containment member or cover, wherein the containment member may be positioned within a desired portion of the base or risers. A containment member of suitable construction is described more fully in co-pending U.S. patent application Ser. No. 09/039,053 filed on Mar. 13, 1998 and assigned to the same assignee as the present invention, the entire disclosure of which is incorporated herein by reference for any purpose. Without any limitation intended, the drop line may be constructed as a unitary piece or in segmented section, wherein segmented sections is preferred. The advantages of the present invention will become readily apparent to those skilled in the art from a review of the following detailed description of the preferred embodiment especially when considered in conjunction with the claims and accompanying drawings in which like numerals in the several views refer to corresponding parts.

DETAILED DESCRIPTION

Figure 1:
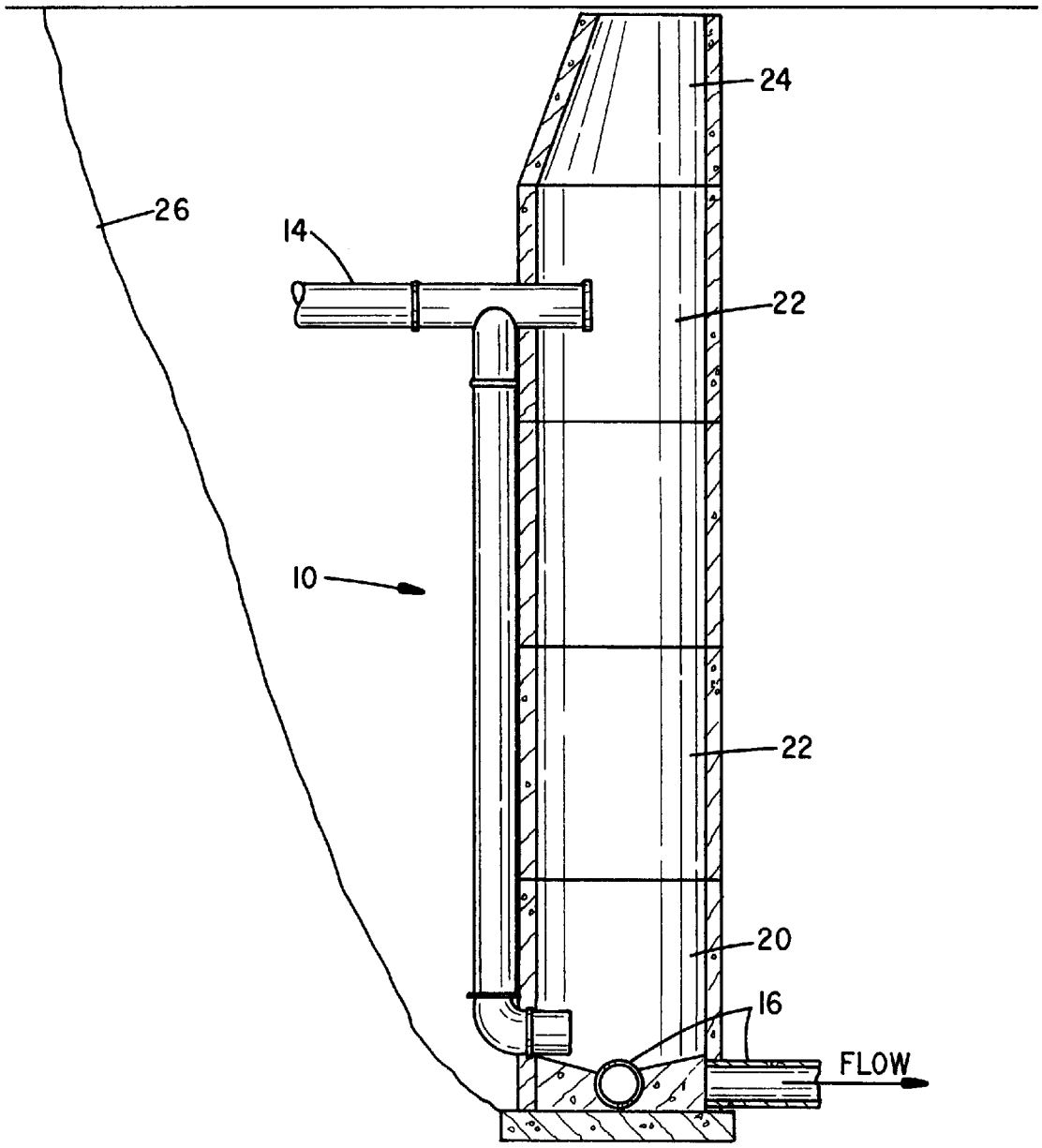
FIG. 1 is a partial sectional side elevational view of a manhole system having an outside drop interconnecting an extension line to a main line within the manhole.
Figure 2:
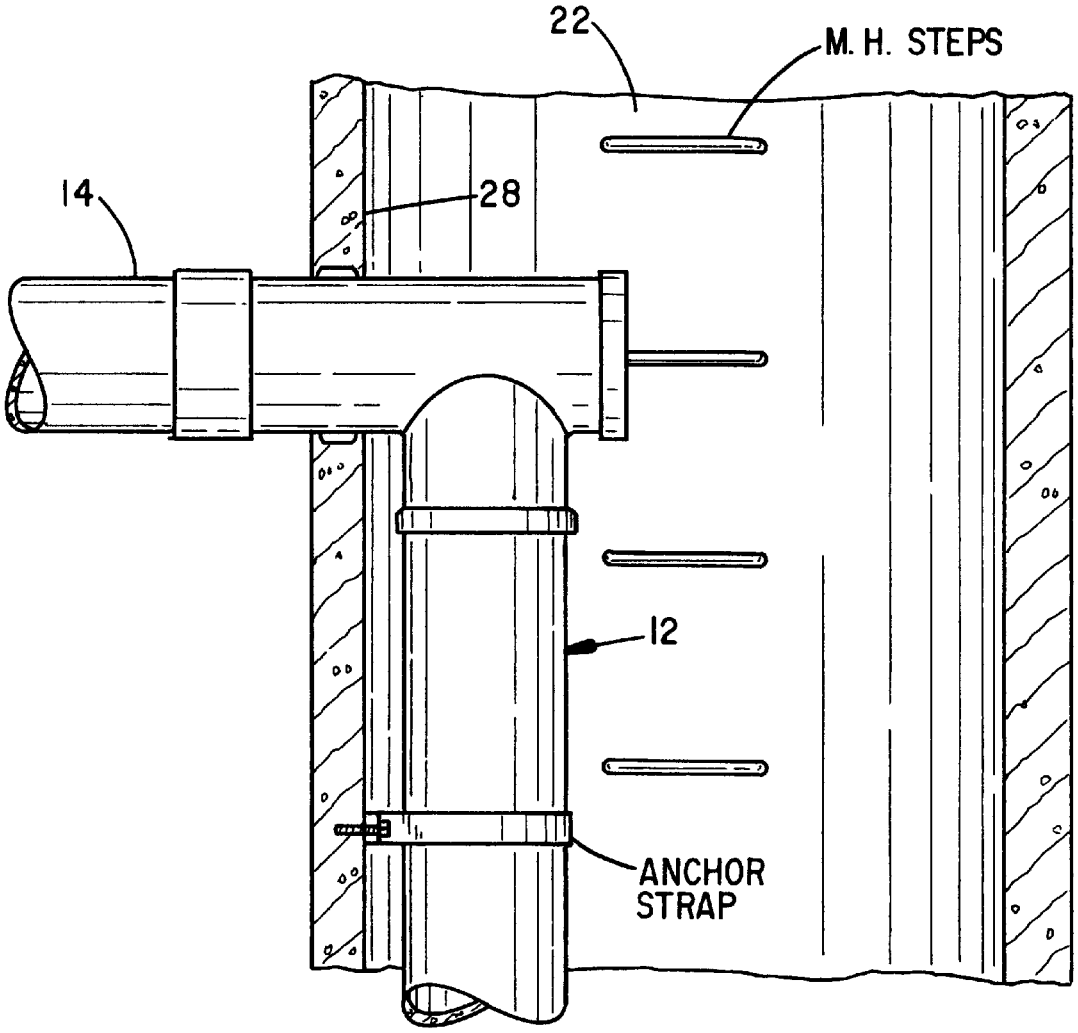
FIG. 2 is a partial sectional fragmentary side elevational view of an upper portion of a conventional inside drop utilizing conventional pipeline.
Figure 3:
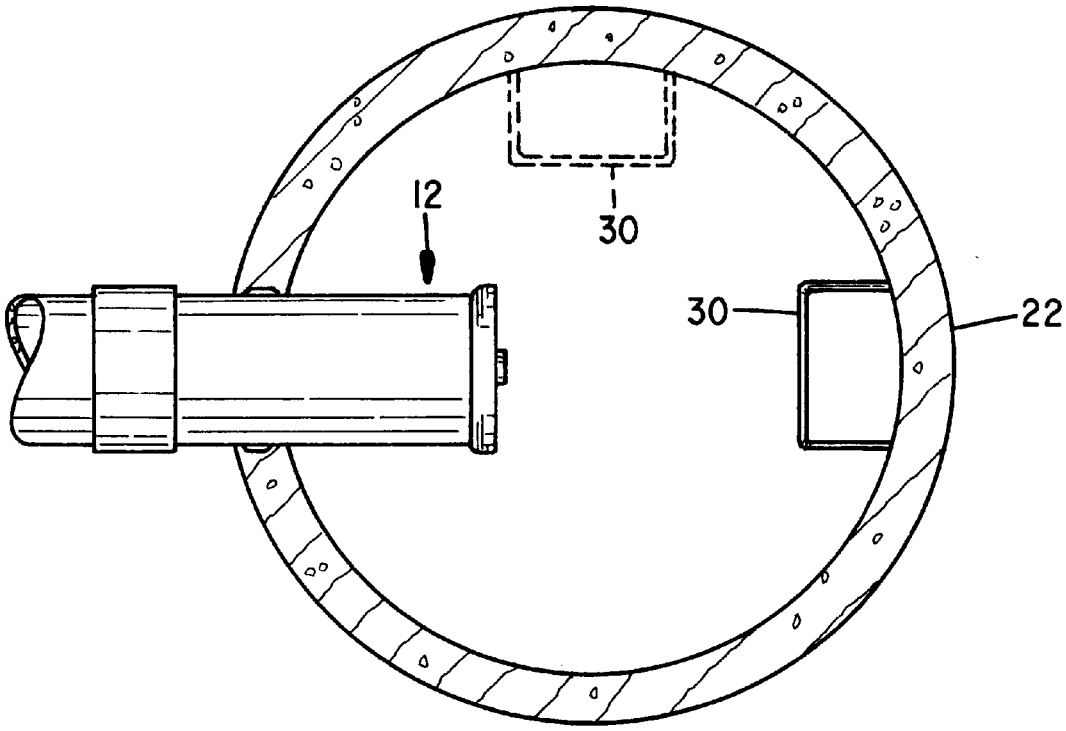
FIG. 3 is a partial sectional fragmentary top plan view of the conventional inside drop of the type shown in FIG. 2.

The present invention represents broadly applicable improvements to the interconnection of an expansion line and main line of a sanitary sewage or storm sewage system. The embodiments detailed herein are intended to be taken as representative or exemplary of those in which the improvements of the invention may be incorporated and are not intended to be limiting. Referring first to FIGS. 1–3 conventional outside and inside drops 10 and 12 respectively are shown for illustrative purposes. The outside and inside drops 10 and 12 are shown interconnecting an extension line 14 with the main line 16 of a manhole system 18. The manhole system 18 is shown including a base 20, risers 22, and cone 24. As seen in FIG. 1, in order to interconnect the extension line 14 to the main line 16 with an outside drop 10, substantial excavation of the substrate 26 around the manhole system 18 down to the base 20 of the manhole is required. Alternatively, a conventional inside drop 12 may be attached to an interior sidewall 28 of the manhole 18 to avoid the substantial excavation around the manhole (see FIGS. 2 and 3). As seen in FIG. 3, steps 30 extend from the riser 22 towards the center of the riser, but do not unacceptably block access therethrough. The conventional inside drop 12, however, extends significantly towards the center of the riser 22 and may unacceptably obstruct access therethrough. The low profile inside drop 40 of the present invention does not extend towards the center of the riser 22 a significant amount more than the ladders 30.

Figure 4:
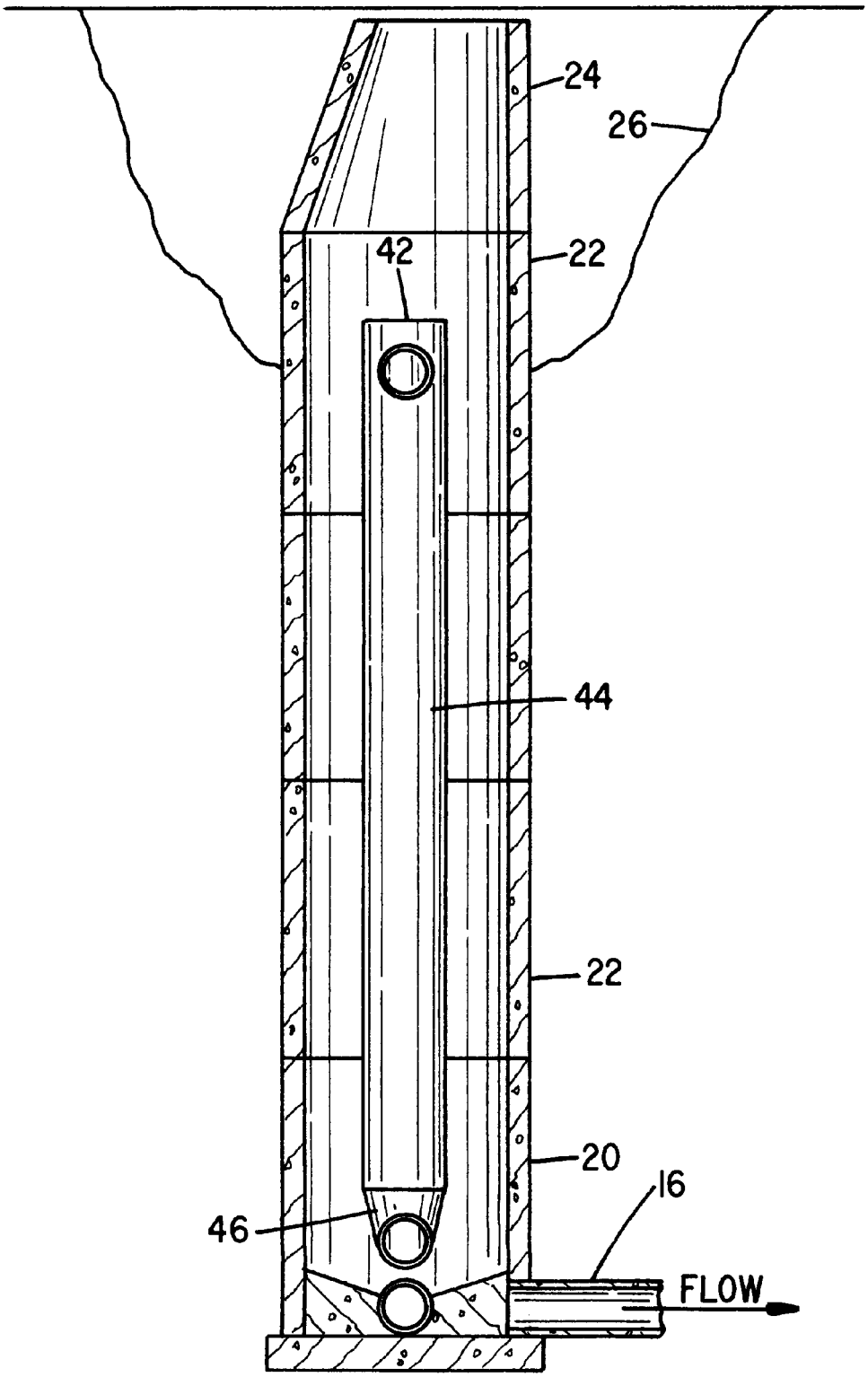
FIG. 4 is a partial sectional side elevational view of a manhole system having a low profile inside drop of the present invention interconnecting an extension line to a main line within the manhole.
Figure 5:
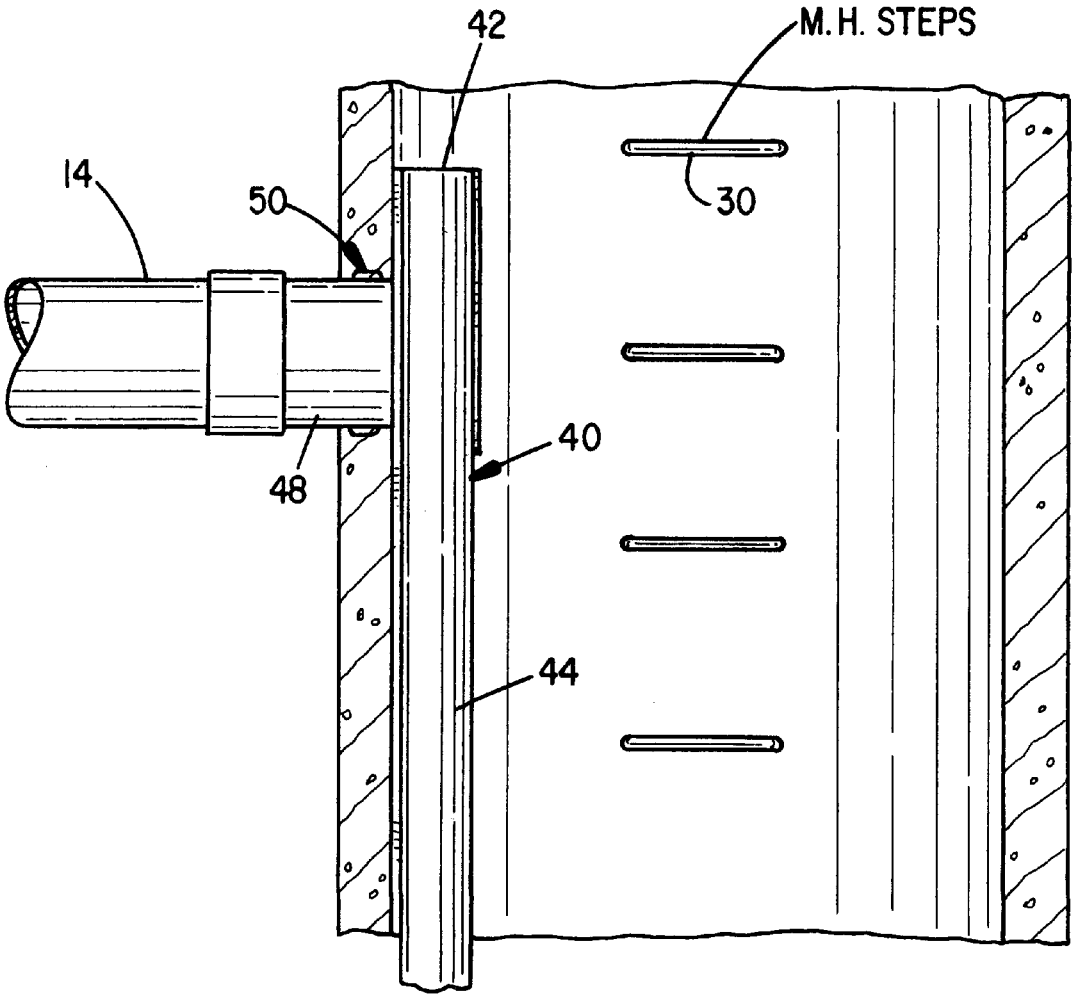
FIG. 5 is a partial sectional fragmentary side elevational view of an upper portion of the inside drop of the present invention.
Figure 6:
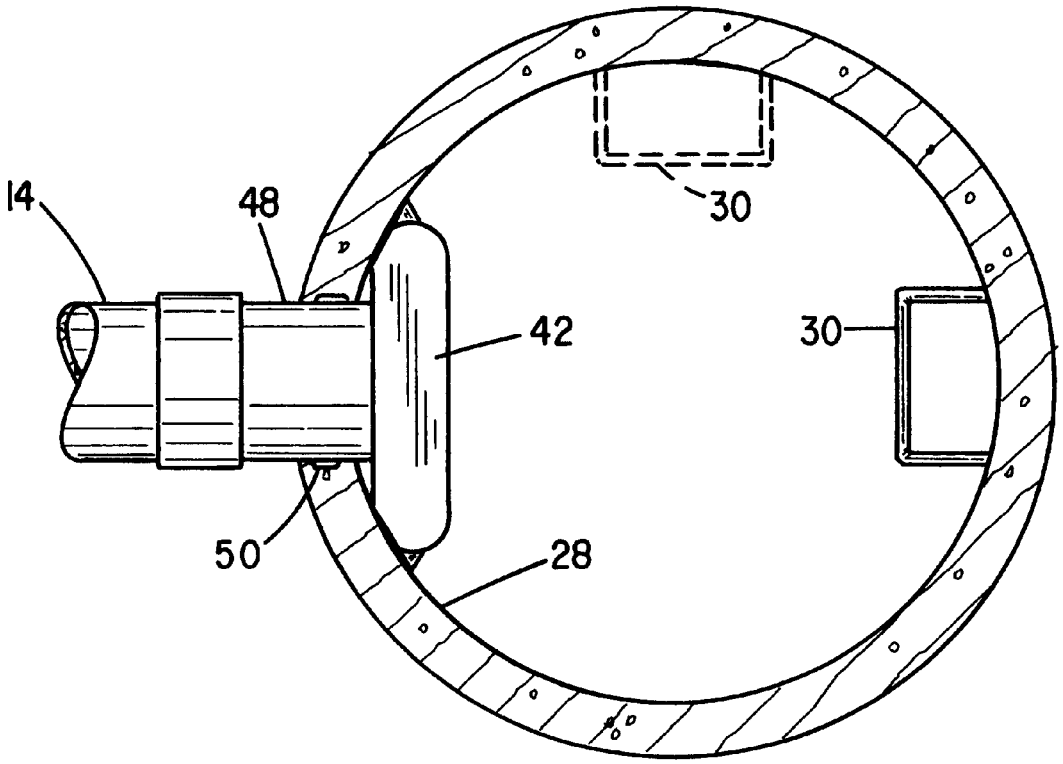
FIG. 6 is a partial sectional fragmentary top plan view of the upper portion of the inside drop of the present invention.

For ease of discussion and illustrative purposes, the low profile inside drop 40 will be described in connection with a manhole system 18. Referring to FIGS. 4–6 the low profile inside drop 40 includes an upper section 42, mid section 44, and lower section 46. A coupling 48 interconnects the extension line 14 to the upper section 42 of the low profile inside drop 40. A seal 50 of known suitable construction is positioned between the coupling 48 and sidewall of the bore formed in the manhole sidewall 28. The seal inhibits freatic water from seeping into the manhole system. A joint of known suitable construction may be utilized to join the coupling 48 to the upper section 42 of the of the inside drop.

Figure 7:
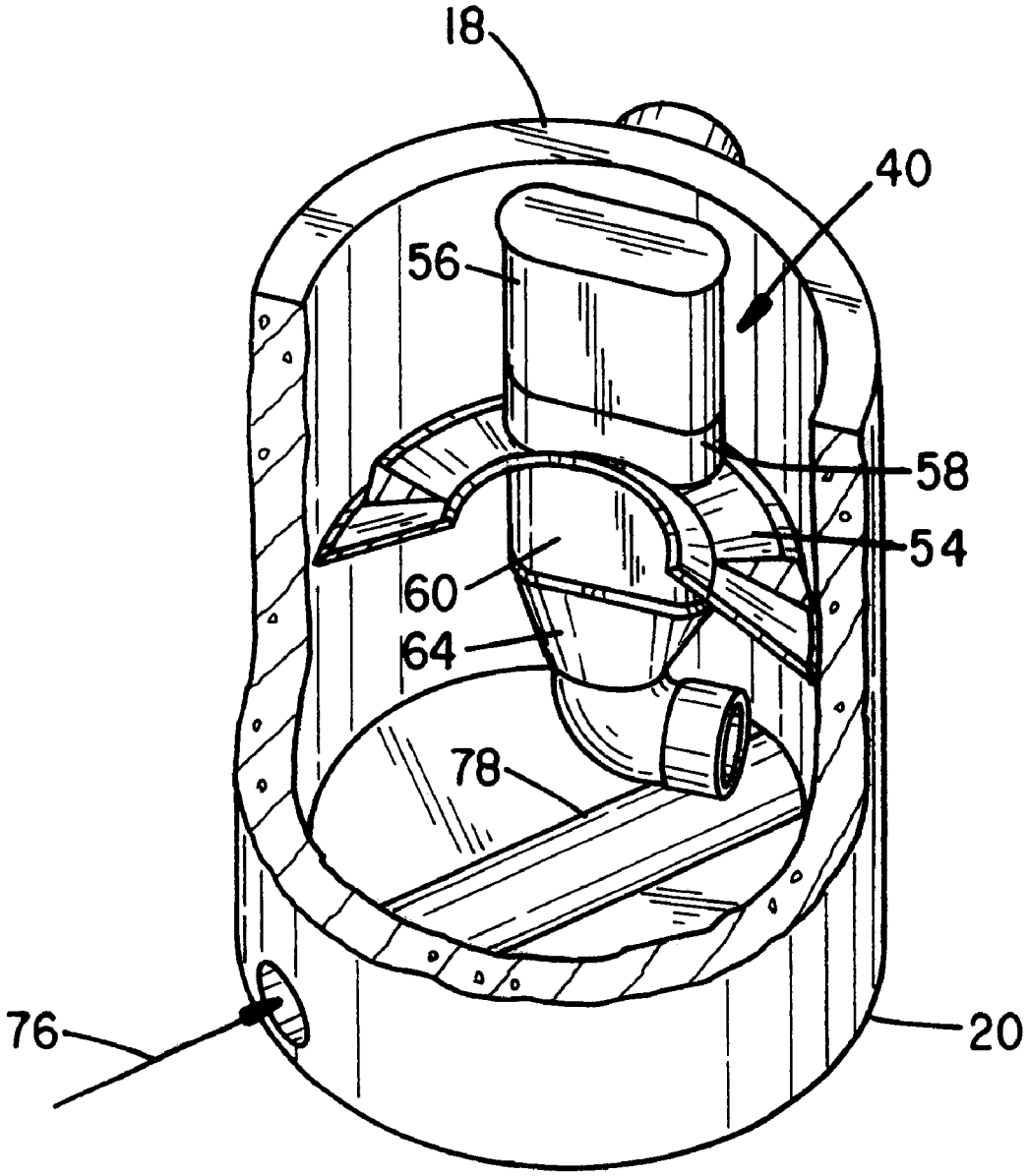
FIG. 7 is a side elevational partial sectional perspective view of an embodiment of the inside drop of the present invention shown positioned within a manhole.
Figure 8:
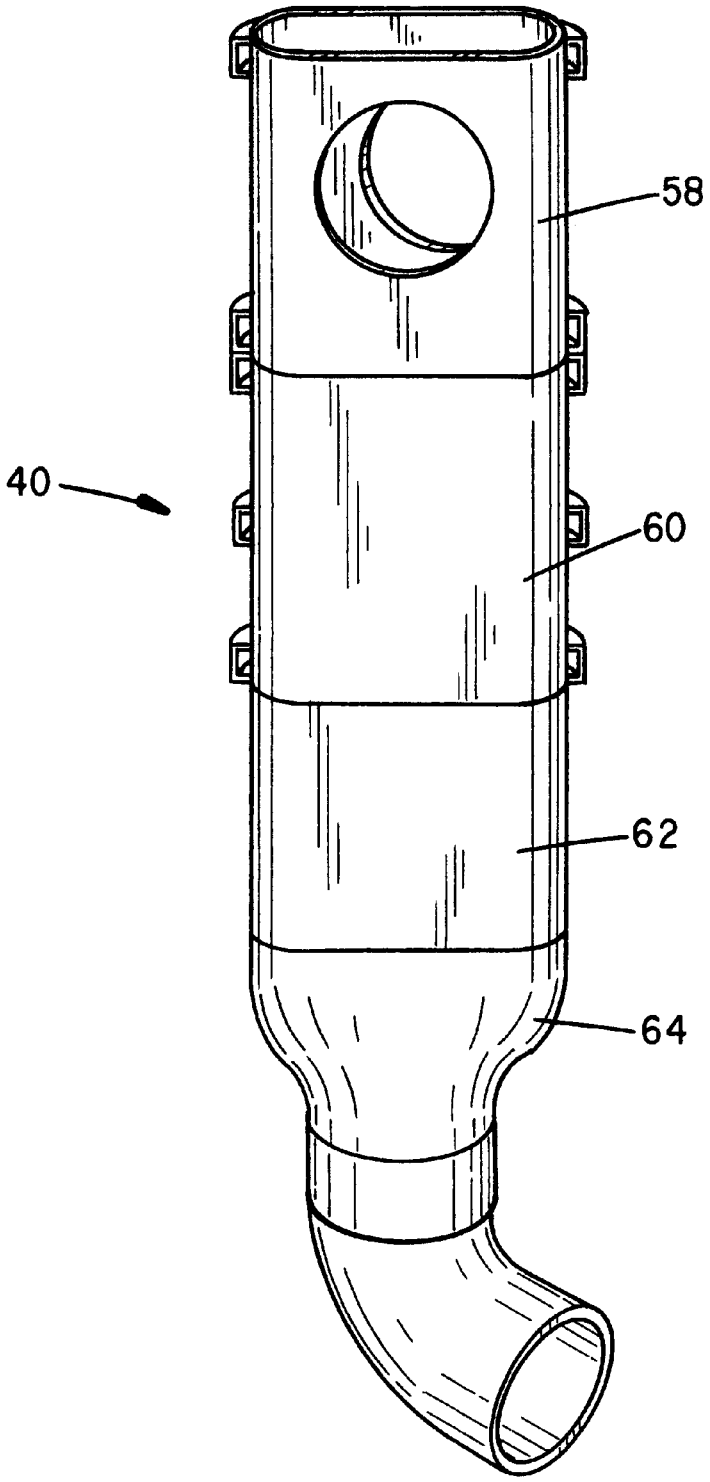
FIG. 8 is a side elevational perspective view of the inside drop of the type shown in FIG. 7, shown removed from the manhole system.
Figure 10:
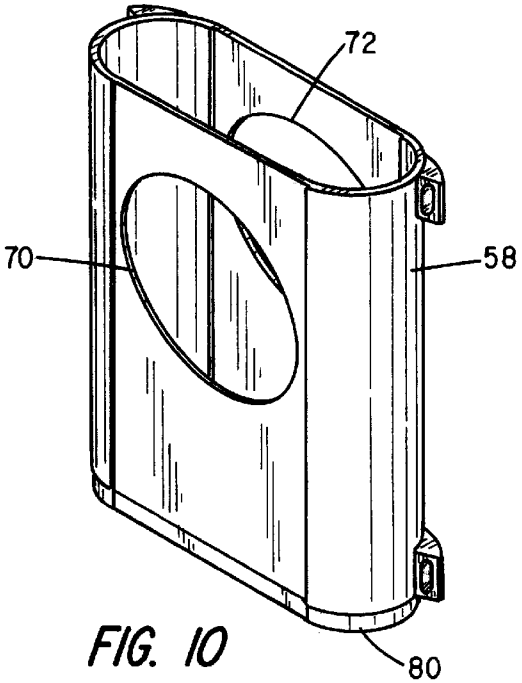
FIG. 10 is a side elevational perspective view of a segment of the inside drop of the type shown in FIG. 7 having an access opening extending through a sidewall of the segment.
Figure 11:
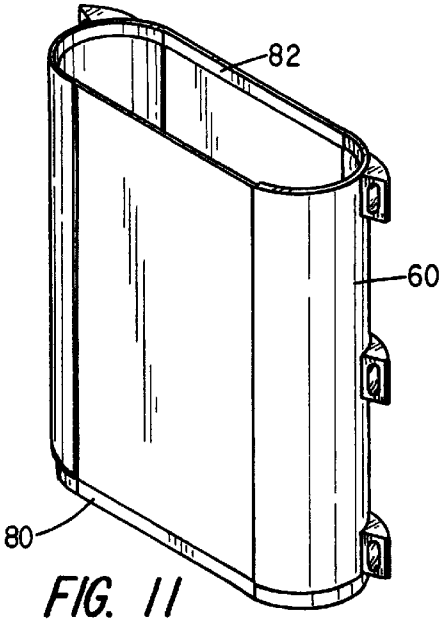
FIG. 11 is a side elevational perspective view of a segment that forms a portion of the low profile mid section of the inside drop of the type shown in FIG. 7.
Figure 9:
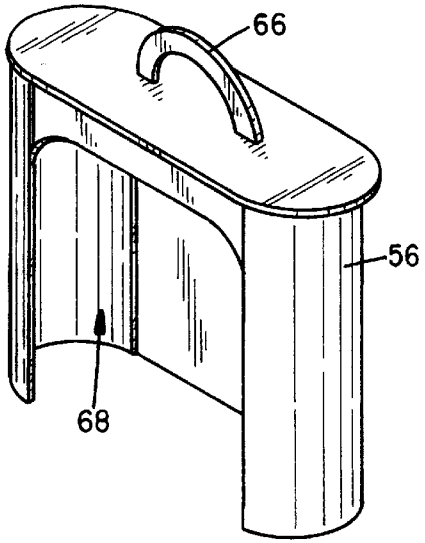
FIG. 9 is a side elevational perspective view of a cover suitable for sealably closing the access opening of the inside drop of the type shown in FIG. 7.
Figure 14:
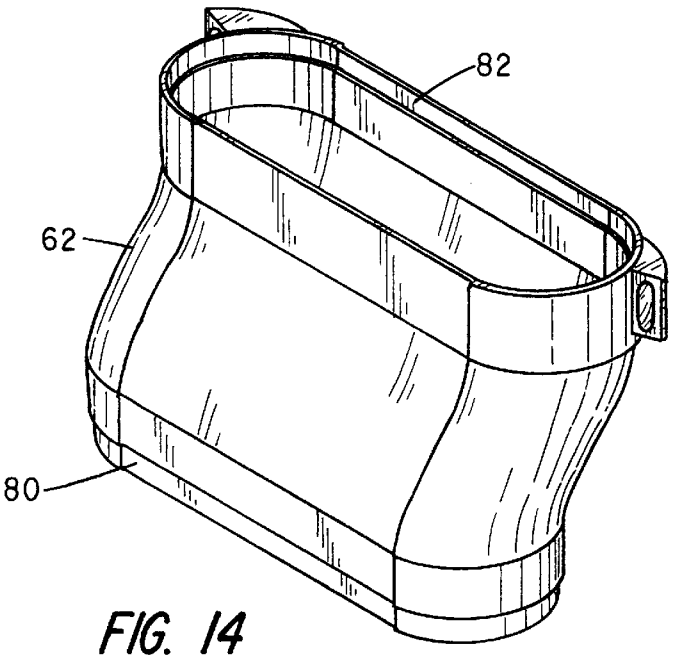
FIG. 14 is a side elevational perspective view of a segment that forms a portion of the low profile mid section of the inside drop of the type shown in FIG. 7.
Figure 16:
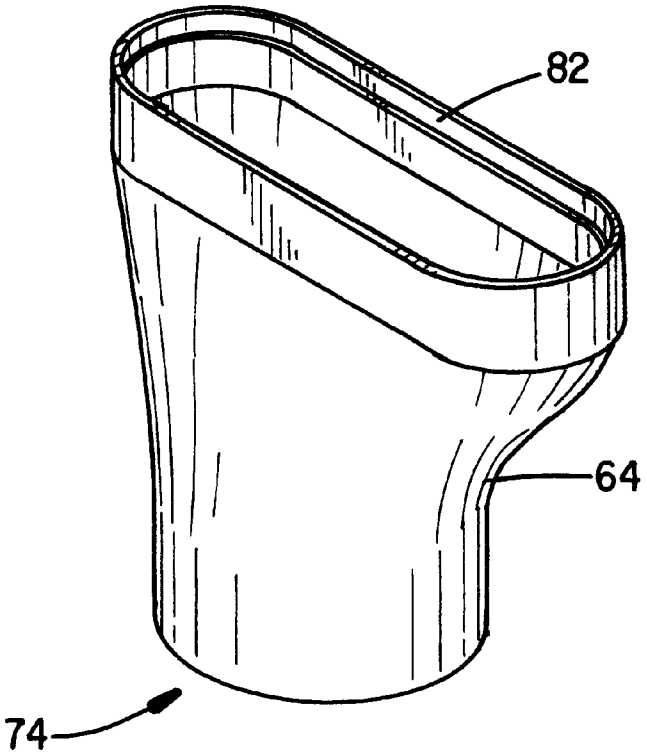
FIG. 16 is a side elevational perspective view of a segment that forms a portion of the low profile lower section of the inside drop of the type shown in FIG. 7.
Figure 15:
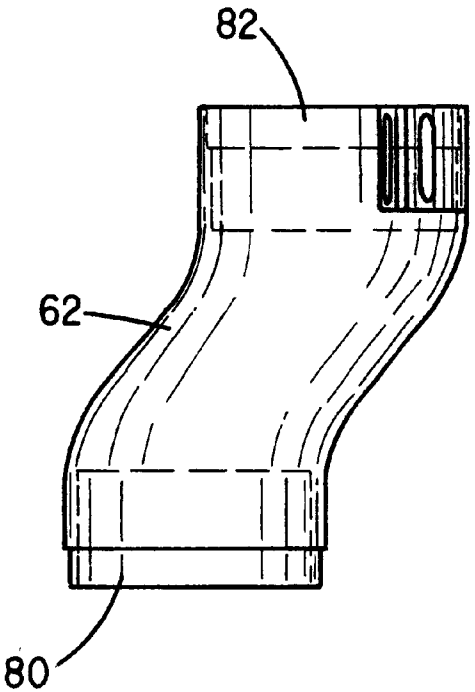
FIG. 15 is a side elevational view of the segment shown in FIG. 14.

Referring now to FIG. 7, an alternate preferred segmented inside drop 40 is shown positioned within a manhole system 18 and interconnected to a containment cover 54. The segmented inside drop 40 includes a cover 56 (shown in greater detail in FIG. 9), upper coupling section 58 (shown in greater detail in FIGS. 8 and 10), middle riser section 60 (shown in greater detail in FIGS. 8 and 11), lower directional sectional 62 (shown in greater detail in FIGS. 8, 14 and 15), and lower coupling section 64 (shown in greater detail in FIGS. 8 and 16). The cover 56 includes a handle 66 and opening 68, wherein the cover 56 is sized and shaped to slip over the upper coupling section. The upper coupling section 58 includes bores 70 and 72 extending through the sidewalls. The coupling 48 is sealably joined to the bore or opening 72. The cover 56 sealably encloses bore 70 when the cover 56 is engaged with the upper coupling section 58. When the cover 56 is removed, the extension line 14 is accessible through the bores 70 and 72. The directional section 62 may take on any of several shapes including the illustrated s-shape. The shape may be changed in order that the lower coupling section 64 is centered over a desired portion of the base 20. Further, several directional sections 62 may be combined to position the outlet 74 of the lower coupling section 64 in a desired direction relative to the flow of fluids (represented by arrow 76 in FIG. 7) through the channel 78 of the base 20.

Figure 13:
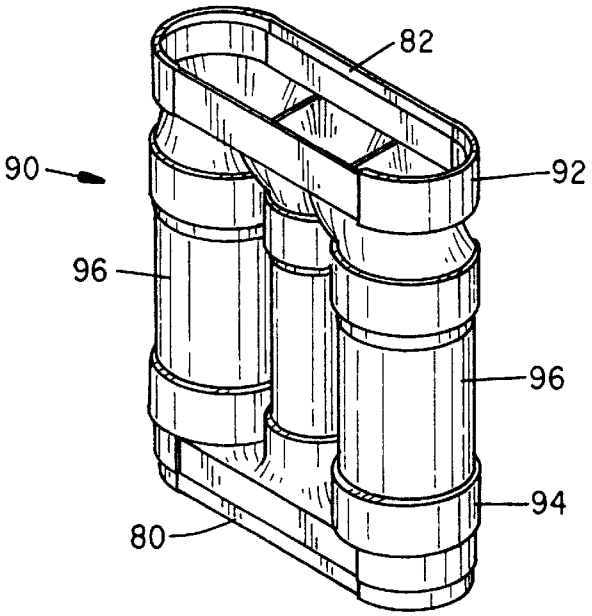
FIG. 13 is a side elevational perspective view of an alternate embodiment of the low profile mid section of the inside drop of the present invention.
Figure 12:
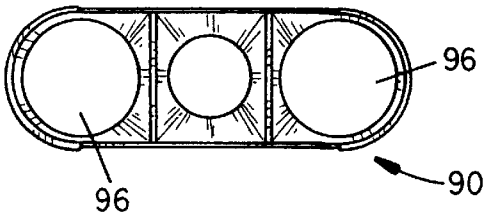
FIG. 12 is a top plan view of an alternate embodiment of the low profile mid section of the inside drop of the present invention.

Each segmented section 58–64 includes lap joints 80 and 82 to thereby sealably join the segments. Further, each segmented section may include an extension member 84 having a slot 86 extending therethrough, wherein a lag bolt may pass through the slot 86 to secure the segment to the manhole sidewall 28. Those skilled in the art will appreciate that other suitable fasteners or the like may be utilized to secure the inside drop to the manhole sidewall 28. Referring to FIGS. 12 and 13 an alternate preferred middle section 90 is shown. The middle section 90 includes an upper and lower manifold 92 and 94 interconnecting a plurality of conduits 96. The conduits 96 have a diameter small enough to not do not unacceptably block access therethrough, yet in combination allow for a high volume of fluids to pass therethrough. The middle section includes lap joints 80 and 82 to thereby interconnect between the upper coupling section 58 and directional section 62 or lower coupling section 64.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. An inside drop for linking a main sewage line to an expansion sewage line, wherein the main sewage line includes a manhole or catch basin structure having a base and sidewalls, the sidewalls extending upwardly from the base, said inside drop comprising:

a drop line forming a fluid conduit between an expansion line and a main line, said drop line having an upper section adaptable for interconnection with the expansion line, a low profile middle section extending from a lower portion of said upper section and attached to an internal sidewall of the structure, and a lower section extending from a lower portion of said low profile middle section, wherein said lower section directs fluid into the main line.

2. The inside drop as recited in claim 1, wherein said low profile middle section has at least a partially oblong cross-section through a longitudinal axis of said low profile middle section.

3. The inside drop as recited in claim 1, further including an access opening formed in the upper section of said drop line.

4. The inside drop as recited in claim 3, further including a cover adapted to sealably engage the access opening formed in said drop line.

5. The inside drop as recited in claim 1, wherein said lower section includes a directional member that directs a flow of fluid in a desired direction.

6. The inside drop as recited in claim 1, wherein said lower section is suitable for engagement to a containment member positioned within the structure.

7. The inside drop as recited in claim 1, wherein said low profile section is shaped to conform to the contour of the interior of the sidewall.

8. The inside drop as recited in claim 1, wherein said drop line is segmented.

9. The inside drop is recited in claim 1, wherein said drop line is unitary.

10. The inside drop as recited in claim 1, wherein said low profile section is shaped to conform to the contour of the interior of the sidewall.

11. An inside drop for linking a main sewage line to an expansion sewage line, wherein the main sewage line includes a manhole or catch basin structure having a base and sidewalls, the sidewalls extending upwardly from the base, said inside drop comprising:

a drop line forming a conduit between an expansion line and a main line, said drop line having an upper section adaptable for interconnection with the expansion line, a low profile middle section extending from a lower portion of said upper section and attached to an internal sidewall of the structure, and a lower section extending from a lower portion of said low profile middle section, wherein said lower section directs fluid into the main line, said upper section having an access opening formed therein.

12. The inside drop as recited in claim 11, wherein said low profile middle section has an oblong cross section through a longitudinal axis of said low profile middle section.

13. The inside drop as recited in claim 11, further including a cover adapted to sealably engage the access opening formed in said drop line.

14. The inside drop as recited in claim 11, wherein said lower section includes a directional member that directs a flow of fluid in a desired direction.

15. The inside drop as recited in claim 11, wherein said lower section is suitable for engagement to a containment member positioned within the structure.

16. An inside drop for linking a main sewage line to an expansion sewage line, wherein the main sewage line includes a manhole or catch basin structure having a base and sidewalls, the sidewalls extending upwardly from the base, said inside drop comprising:

a drop line forming a conduit between an expansion line and a main line, said drop line having an upper section adaptable for interconnection with the expansion line, a low profile middle section extending from a lower portion of said upper section and attached to an internal sidewall of the structure, and a lower section extending from a lower portion of said low profile middle section and including a directional member that directs a flow of fluid into the main line in a desired direction.

17. The inside drop as recited in claim 16, wherein said low profile middle section has an oblong cross section through a longitudinal axis of said low profile middle section.

18. The inside drop as recited in claim 16, further including an access opening formed in the upper section of said drop line.

19. The inside drop as recited in claim 18, further including a cover adapted to sealably engage the access opening formed in said drop line.

20. The inside drop as recited in claim 16, wherein said lower section is suitable for engagement to a containment member positioned within the structure.

* * * * *